US009187995B2

(12) United States Patent
Johnson

(10) Patent No.: US 9,187,995 B2
(45) Date of Patent: Nov. 17, 2015

(54) PRODUCTION ENHANCEMENT METHOD FOR FRACTURED WELLBORES

(71) Applicant: Baker Hughes Incorporated, Houston, TX (US)

(72) Inventor: Michael H. Johnson, Katy, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 396 days.

(21) Appl. No.: 13/671,735

(22) Filed: Nov. 8, 2012

(65) Prior Publication Data

US 2014/0124207 A1 May 8, 2014

(51) Int. Cl.
*E21B 33/124* (2006.01)
*E21B 43/12* (2006.01)
*E21B 43/267* (2006.01)

(52) U.S. Cl.
CPC ..... *E21B 43/267* (2013.01)

(58) Field of Classification Search
CPC ..... E21B 33/124; E21B 43/26; E21B 43/25; E21B 43/267; E21B 43/04; E21B 43/08; E21B 43/14; E21B 43/12
See application file for complete search history.

(56) References Cited

U.S. PATENT DOCUMENTS

| | | | | |
|---|---|---|---|---|
| 5,394,938 | A * | 3/1995 | Cornette et al. | 166/51 |
| 6,220,345 | B1 * | 4/2001 | Jones et al. | 166/51 |
| 6,253,851 | B1 | 7/2001 | Schroeder, Jr. et al. | |
| 6,289,990 | B1 | 9/2001 | Dillon et al. | |
| 6,409,219 | B1 | 6/2002 | Broome et al. | |
| 8,567,498 | B2 * | 10/2013 | Scott et al. | 166/278 |
| 2002/0079099 | A1 * | 6/2002 | Hurst et al. | 166/278 |
| 2002/0189809 | A1 * | 12/2002 | Nguyen et al. | 166/278 |
| 2003/0034160 | A1 * | 2/2003 | Nguyen et al. | 166/278 |
| 2003/0141061 | A1 * | 7/2003 | Hailey et al. | 166/278 |
| 2006/0196660 | A1 * | 9/2006 | Patel | 166/250.15 |
| 2009/0044944 | A1 * | 2/2009 | Murray et al. | 166/308.1 |
| 2009/0288824 | A1 * | 11/2009 | Fowler et al. | 166/250.17 |
| 2010/0051262 | A1 * | 3/2010 | Dusterhoft et al. | 166/236 |

OTHER PUBLICATIONS

Ye, X., et al., "Experiment and Simulation Study of Proppant Pack Compression", SPE 151647. Feb. 2012, 1-12.

Krismartopo, B.D., et al., "A Fracture Treatment Design Optimization Process to Increase Production and Control Proppant Flowback for Low-Temperature, Low-Pressure Reservoirs", SPE 93168, Apr. 2005, 1-12.

Singh, I., et al., A Numerical Study of the Effects of Packer-Induced Stresses and Stress Shadowing on Fracture Initiation and Stimulation of Horizontal Wells, CSUG/SPE 136856, Oct. 2010.

(Continued)

*Primary Examiner* — Shane Bomar
*Assistant Examiner* — Kipp Wallace
(74) *Attorney, Agent, or Firm* — Steve Rosenblatt

(57) ABSTRACT

Wellbores are fractured by setting open hole packers on a string with access through valves on the string between the set packers. Setting the packers creates wellbore stress so that fractures tend to preferentially form near the packers regardless of the orientation of the borehole. When the fracturing is done and the well is put on production some of the proppant comes back into the wellbore and packs around the packers with solids that can be produced from the formation carried by flowing fluids. An annular passage is created near the packer to allow produced fluids to bypass the packed proppant and other solids to get into the production string. A screen protects the passage from clogging so that production is enhanced.

16 Claims, 2 Drawing Sheets

(56) References Cited

OTHER PUBLICATIONS

Nguyen, Philip, et al., "Controlling Solids Flowback to Maintain Production of Hydrocarbons: A Review of Successful Chemical Technologies in the Last Decade", IPTC 13725, Dec. 2009, 1-18.

Roundtree, Russell, et al., "Horizontal, Near-Wellbore Stress Effects on Fracture Initiation", SPE 123589, Apr. 2009, 1-17.

Evans, K., "A Laboratory Study of Two Straddle-Packer Systems Under Simulated Hydrofrac Stress—Measurement Conditions", Transactions of the ASME, Dec. 1987, vol. 109, 180-190.

* cited by examiner

PRODUCTION ENHANCEMENT METHOD FOR FRACTURED WELLBORES

FIELD OF THE INVENTION

The field of the invention is wellbores that are fractured with proppant laden fluid before being produced and more particularly wellbores that are divided into zones by spaced packers in open hole with valves in a string that connects the packers for ultimate production between the pairs of packers.

FIELD OF THE INVENTION

Current multi-zone fracturing technology utilizes multiple sleeves that are isolated with packers with the intent of opening the sleeves to fracture an area between the packers. It has been noted that packers exert a force on the borehole in order to form a seal to contain the fracturing pressures applied through the opened sleeves. If the packers did not exert some force there would be no sealing or containment of the fracturing fluids and pressures. Many times the forces applied by the packers is additive to the fluid pressure forces and a fracture will initiate at one or both of the packers sealing the area around the frac sleeves. As a result of this, the fracture is created some distance from the frac sleeves which are used as production entry points when the well is placed on production. As fluids or gases are produced from the fracture, proppant can flow out of the fracture and fill the annular space between the production conduit and the borehole causing a blockage or additional pressure drop to fluid or gas production. This problem can be mitigated or reduced by placing a shrouded cover over the outside of the production conduit which would allow an unobstructed flow path for produced fluids to flow in the production conduit/wellbore annulus into the sleeve. Not only would this mitigate pressure losses, it would also reduce drag on proppant in the annular spaces an also help mitigate production of proppant which could cause production conduit restrictions or problems with proppant entering production facilities.

FIG. 1 illustrates the problem with present techniques of fracturing and subsequent production in either a horizontal or vertical wellbore. An open hole borehole 10 is divided into zones such as 12 that are defined between open hole packers 14 and 16. As stated before, the set open hole packers exert a stress on the borehole to hold the sealed position and this preferentially encourages fractures 18 to form adjacent the packers 14 or 16 regardless of the orientation of the borehole 10 from vertical to horizontal or something in between. As the fracturing commences the proppant 20 goes into the fractures as intended to hold them open for ultimate production. As the zone is then put on production some of the proppant 20 that was in the fractures 18 close to the packers 14 or 16 will flow back into the wellbore 10 in between the packers and will accumulate as indicated at 22 to add resistance to fluid flow and thus limiting the subsequent production.

The present invention addresses this production reducing phenomenon that can happen at one or both packer that define an isolated zone by giving the fluids produced an alternate path to bypass the accumulates proppant or sand or other solids carried into the wellbore 10 from the fractures 18 near packers 14 or 16.

U.S. Pat. No. 6,409,219 and the references cited in that patent address tubes to convey gravel around bridges to get a complete gravel pack around screens. The deposition of gravel can also involve fracturing in a method known as frac/pack where the fluid returns from the screens for the liquid that comprises the gravel slurry are blocked off forcing the fluid into the formation with some of the gravel or proppant to hold the fractures open while depositing the gravel in the surrounding annular space around the screen sections. The present invention employs a bypass concept but in a different context so that produced fluids can more easily be produced by a bypassing of the accumulated and compacted proppant in the wellbore 10 as a result of the initiation of the production phase. U.S. Pat. No. 6,253,851 addresses screen placement to minimize gravel bridging during gravel deposition.

Shunts are used in drainage contexts such as U.S. Pat. No. 6,289,990.

Those skilled in the art will more readily appreciate more aspects of the invention from a review of the detailed description of the preferred embodiment and the associated drawing while understanding that the full scope of the invention is to be determined by the appended claims.

SUMMARY OF THE INVENTION

Wellbores are fractured by setting open hole packers on a string with access through valves on the string between the set packers. Setting the packers creates wellbore stress so that fractures tend to preferentially form near the packers regardless of the orientation of the borehole. When the fracturing is done and the well is put on production some of the proppant comes back into the wellbore and packs around the packers with solids that can be produced from the formation carried by flowing fluids. An annular passage is created near the packer to allow produced fluids to bypass the packed proppant and other solids to get into the production string. A screen protects the passage from clogging so that production is enhanced.

DETAILED DESCRIPTION OF THE PREFERRED EMBODIMENT

Figure 1:
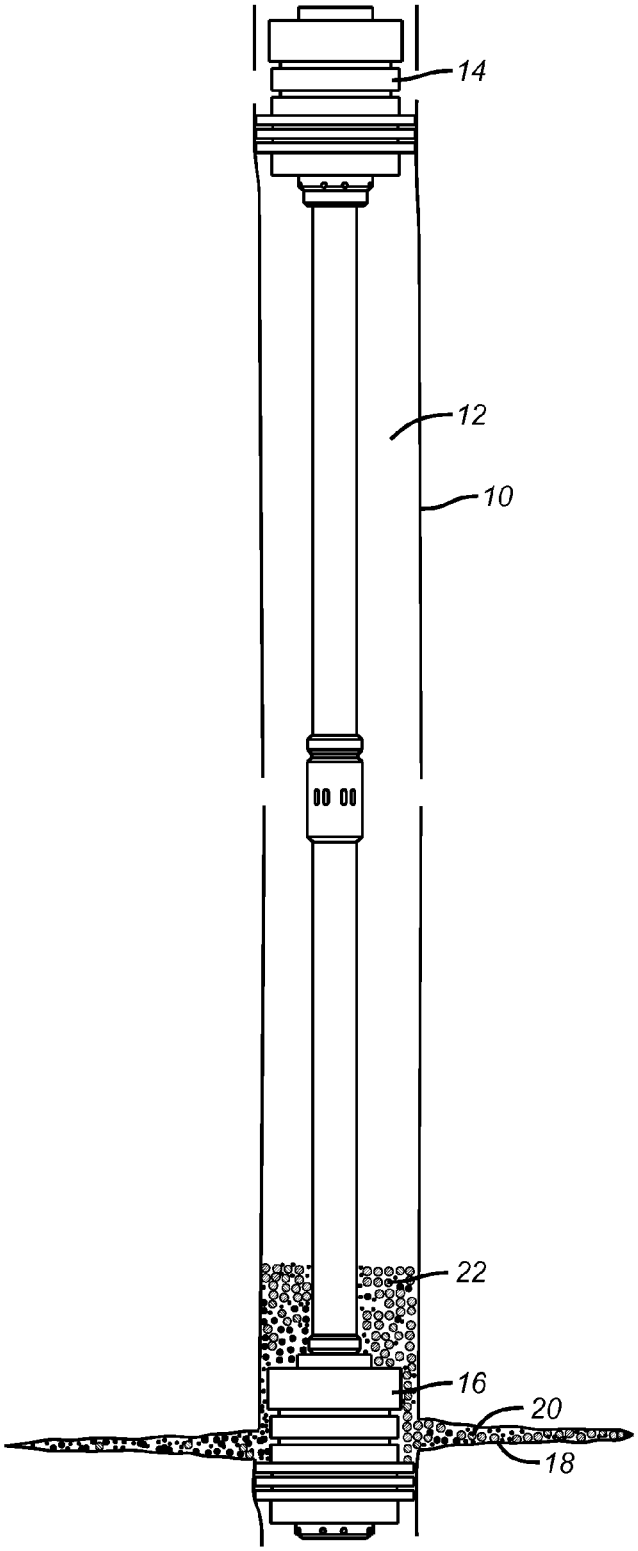
(PRIOR ART) FIG. 1
FIG. 1 is a view of a zone in a wellbore after fracturing showing the proppant buildup adjacent a packer as a result of subsequent production.
Figure 2:
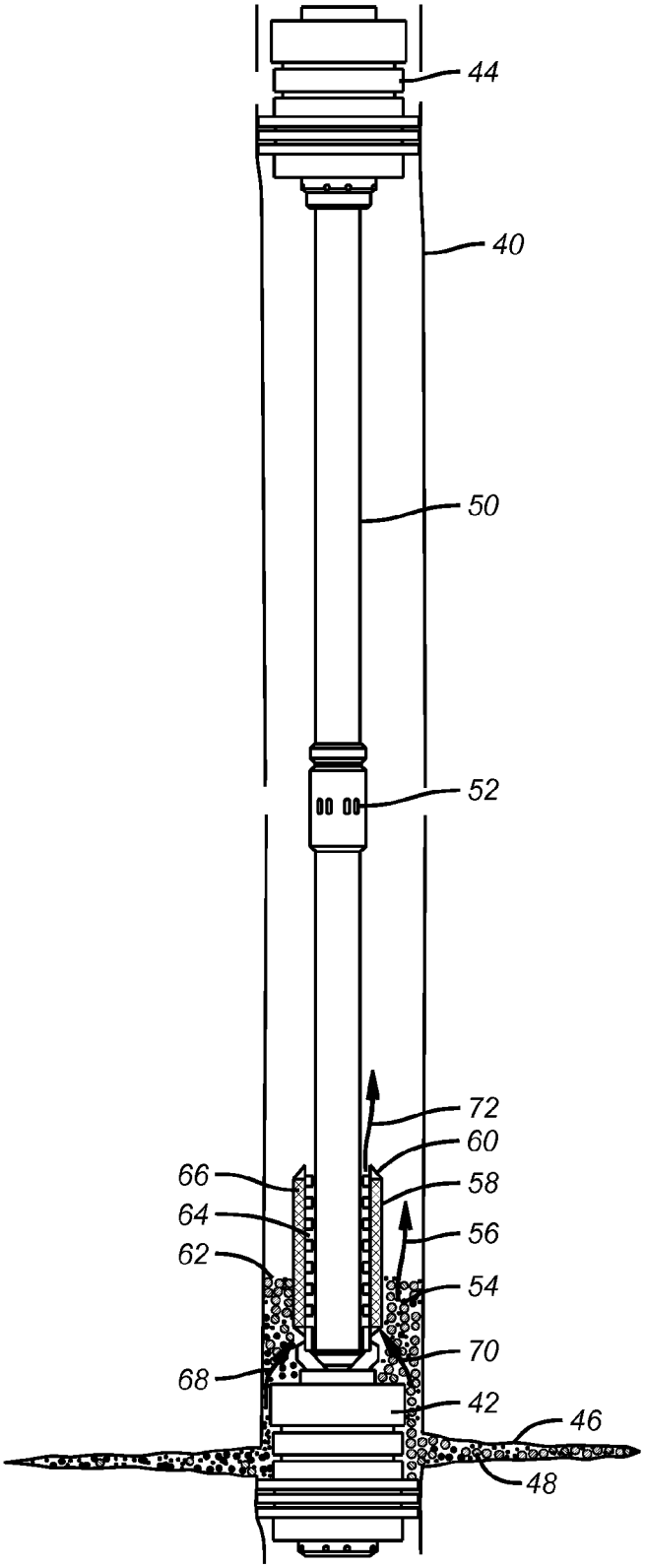
FIG. 2 is the view of FIG. 1 showing the addition of the fluid bypass around the packed proppant and other solids produced from the formation during production.

Referring to FIG. 2 the isolated open hole zone 40 is defined by a pair of open hole packers 42 and 44. Zone 40 can be one of many zones in a borehole isolated by at least one packer or a pair of packers. The setting of the open hole packers 42 and 44 creates localized stresses that result in preferential fracture 46 formation near the packers as illustrated at packer 42 but which is equally applicable at packer 44. Fluid under pressure that carries proppant 48 is delivered through string 50 that supports the packers in the wellbore. Between pairs of packers such as 42 and 44 there is a sliding sleeve or other valve that can be opened with a dropped ball on a seat that shifts the sleeve to open the ports 52. The fluid then goes into the fractures that are created with high pressure and takes the proppant 48 into the fractures such as 46 as well as all the other fractures that have formed from pressure pumping through ports 52.

When production starts some of the proppant 48 and solids from the formation come into the zone 40 and pack in near the packer such as 42 because the velocity is too low to carry these solids to the openings 52. However, the packing in of solids at 54 creates a great resistance to flow represented by arrow 56. In an effort to maintain production from the fracture 46 a bypass or alternate path tube 58 that has an upper end 60 that is spaced apart from the top 62 of the anticipated buildup of solids is placed around the tubular string 50 so that a bypass passage 64 having a screen 66 therein to keep it solids free is created. The screen 66 can be wire wrap, or sintered metal, foam or weave to name a few options. The flow is from the fracture 46 and around the body of the packer 42 as indicated by arrow 68. Arrows 70 and 72 represent the flow getting into the tube 58 and solids being held back by screen 66 allowing fluid to exit from upper end 60 on the way to the openings 52. The path of greater resistance through the accumulated solids outside the tube 58 becomes the path of greater resistance and sees less flow but the existence of the flow path through the tube 58 more than compensates for the added resistance through the solid pack at 54.

While the tube 58 is shown as a cylindrical tube the wall can have a taper and the wall can also have openings with the internal screen 66 keeping solids from getting into the annular passage defined between the string 50 and the tube 58. Optionally there can be a bottom inlet to the annular passage and side inlets through wall openings in tube 58 with screen 66 on the inside of tube 58 or on the outside or both so as to screen whatever bypass regime is used to enhance flow around the solids pack 54.

The above description is illustrative of the preferred embodiment and many modifications may be made by those skilled in the art without departing from the invention whose scope is to be determined from the literal and equivalent scope of the claims below:

I claim:

1. A completion and production method for a borehole, comprising:

running in at least one pair of spaced packers on a string having at least one port between the packers for flow communication into an annular space between said packers and then radially in said annular space toward said string into said at least one port when a zone is placed in production;

setting the packers in the borehole to define the zone between the packers;

fracturing the zone with pressure pumping a slurry;

placing the zone on production after said fracturing;

accumulating slurry solids or formation produced solids from the produced zone in said annular space adjacent one of said spaced packers that impedes said production flow in said annular space in reaching said at least one port;

providing a bypass passage outside said string and within said annular space along a portion of said string without wall openings for fluid to flow into said annular space and then substantially parallel to said string through said bypass passage from the fractures previously created, said passage comprising a first passage end adjacent said solids and a second passage end outside of said accumulated solids in said annular space and adjacent another portion of said string without wall openings, whereupon exiting said second end said fluid flow continuing substantially parallel to said string into said annular space toward said at least one port while experiencing reduced resistance to flow in said bypass passage as compared to flowing in said annular space through slurry solids or formation produced solids that accumulated by said packer in said annular space.

2. The method of claim 1, comprising:

providing a sleeve around said string to define said bypass passage.

3. The method of claim 2, comprising:

screening said passage with a screen to substantially exclude said solids while allowing fluid to pass.

4. The method of claim 1, comprising:

reducing resistance to fluid flow from fractures adjacent a packer with said bypass passage.

5. The method of claim 3, comprising:

locating said screen inside said sleeve.

6. The method of claim 3, comprising:

locating said screen outside said sleeve.

7. The method of claim 1, comprising:

using open hole packers to define an open hole zone between said packers.

8. The method of claim 1, comprising:

orienting the borehole horizontally or vertically or at a slant in between horizontal or vertical.

9. The method of claim 1, comprising:

providing a sliding sleeve associated with said port.

10. The method of claim 1, comprising:

performing said fracturing with proppant.

11. The method of claim 2, comprising:

providing screened openings in the wall of said sleeve.

12. The method of claim 3, comprising:

using open hole packers to define an open hole zone between said packers.

13. The method of claim 3, comprising:

orienting the borehole horizontally or vertically or at a slant in between horizontal or vertical.

14. The method of claim 13, comprising:

providing a sliding sleeve associated with said port.

15. The method of claim 14, comprising:

performing said fracturing with proppant.

16. The method of claim 15, comprising:

providing screened openings in the wall of said sleeve.

* * * * *